US012655693B2

(12) United States Patent
Storskjær

(10) Patent No.: US 12,655,693 B2
(45) **Date of Patent: *Jun. 16, 2026**

(54) SPLINED/GROOVED 2 PIECE BIT ASSEMBLY

(71) Applicant: Halliburton Energy Services, Inc., Houston, TX (US)

(72) Inventor: André Storskjær, Stavanger (NO)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/057,419

(22) Filed: Feb. 19, 2025

(65) Prior Publication Data

US 2026/0117594 A1 Apr. 30, 2026

Related U.S. Application Data

(63) Continuation of application No. 18/332,993, filed on Jun. 12, 2023, now Pat. No. 12,241,311.

(51) Int. Cl.

| | |
|---|---|
| ***E21B 10/30*** | (2006.01) |
| ***E21B 7/06*** | (2006.01) |
| ***E21B 10/62*** | (2006.01) |
| ***E21B 10/64*** | (2006.01) |

(52) U.S. Cl.

CPC ..... *E21B 10/30* (2013.01); *E21B 7/061* (2013.01); *E21B 10/62* (2013.01); *E21B 10/64* (2013.01)

(58) Field of Classification Search

CPC ..... E21B 10/62; E21B 10/64; E21B 7/061

See application file for complete search history.

(56) References Cited

U.S. PATENT DOCUMENTS

| | | | |
|---|---|---|---|
| 3,116,799 | A | 1/1964 | Lemons |
| 3,194,327 | A | 7/1965 | Smithson |
| 5,467,819 | A | 11/1995 | Braddick |
| 5,551,509 | A | 9/1996 | Braddick |
| 6,032,740 | A | 3/2000 | Schnitker et al. |
| 6,105,675 | A | 8/2000 | Buytaert et al. |
| 6,202,761 | B1 | 3/2001 | Forney |
| 6,464,002 | B1 | 10/2002 | Hart et al. |

(Continued)

FOREIGN PATENT DOCUMENTS

| | | | |
|---|---|---|---|
| EP | 1272729 | A1 | 1/2003 |

*Primary Examiner* — Giovanna Wright

(74) *Attorney, Agent, or Firm* — Scott Richardson; Parker Justiss, P.C.

(57) ABSTRACT

Provided is a two part drilling and running tool, a downhole tool, a well system, and a method for forming a well system. The two part drilling and running tool, in at least one aspect, includes a smaller assembly coupled to an end of a conveyance, the smaller assembly having a spline or slot located along an entire length ($L_S$) thereof. The two part drilling and running tool, in accordance with this aspect, further includes a larger bit assembly slidably coupled to the conveyance, the larger bit assembly including an other of the slot or spline, wherein the spline or slot in the smaller assembly and the other of the slot or spline in the larger bit assembly are configured to engage one another to rotationally fix the smaller assembly relative to the larger bit assembly as the smaller assembly and the larger bit assembly slidingly engage one another.

26 Claims, 13 Drawing Sheets

(56) References Cited

U.S. PATENT DOCUMENTS

| | | | |
|---|---|---|---|
| 10,577,882 | B2 | 3/2020 | Hulsewe |
| 10,724,322 | B2 | 7/2020 | Taylor, Jr. et al. |
| 11,053,741 | B1 | 7/2021 | Davis et al. |
| 11,162,315 | B2 | 11/2021 | Harrington et al. |
| 11,732,539 | B2 | 8/2023 | Nguyen |
| 12,241,311 | B2 * | 3/2025 | Storskjær ..... E21B 10/62 |
| 2008/0173481 | A1 | 7/2008 | Menezes et al. |
| 2012/0261193 | A1 | 10/2012 | Swadi et al. |
| 2014/0216760 | A1 | 8/2014 | Dancer |
| 2015/0361764 | A1 | 12/2015 | Cronley |
| 2016/0237770 | A1 | 8/2016 | Korf |
| 2020/0087987 | A1 | 3/2020 | Campbell et al. |
| 2021/0131185 | A1 | 5/2021 | Pray et al. |
| 2021/0301615 | A1 | 9/2021 | Harrington et al. |
| 2021/0317705 | A1 | 10/2021 | Gregurek et al. |
| 2022/0162915 | A1 | 5/2022 | Zhao et al. |
| 2022/0389771 | A1 | 12/2022 | Niu |
| 2023/0125650 | A1 | 4/2023 | Nguyen |
| 2023/0265718 | A1 | 8/2023 | Lajesic |
| 2023/0265719 | A1 | 8/2023 | Lajesic |
| 2023/0265743 | A1 | 8/2023 | Lajesic |

* cited by examiner

SPLINED/GROOVED 2 PIECE BIT ASSEMBLY

CROSS-REFERENCE TO RELATED APPLICATION

This application is a continuation of U.S. patent application Ser. No. 18/332,993, entitled "SPLINED/GROOVED 2 PIECE BIT ASSEMBLY", filed on Jun. 12, 2023. The above-listed application is commonly assigned with the present application is incorporated herein by reference as if reproduced herein in its entirety.

BACKGROUND

The unconventional market is very competitive. The market is trending towards longer horizontal wells to increase reservoir contact. Multilateral wells offer an alternative approach to maximize reservoir contact. Multilateral wells include one or more lateral wellbores (e.g., secondary wellbores) extending from a main wellbore (e.g., primary wellbore). A lateral wellbore is a wellbore that is diverted from the main wellbore or another lateral wellbore.

Lateral wellbores are typically formed by positioning one or more deflector assemblies (e.g., whipstock assemblies) at desired locations in the main wellbore (e.g., an open hole section or cased hole section) with a running tool. The deflector assemblies are often laterally and rotationally fixed within the primary wellbore using an anchoring assembly.

BRIEF DESCRIPTION

Reference is now made to the following descriptions taken in conjunction with the accompanying drawings, in which.

DETAILED DESCRIPTION

Figure 1:
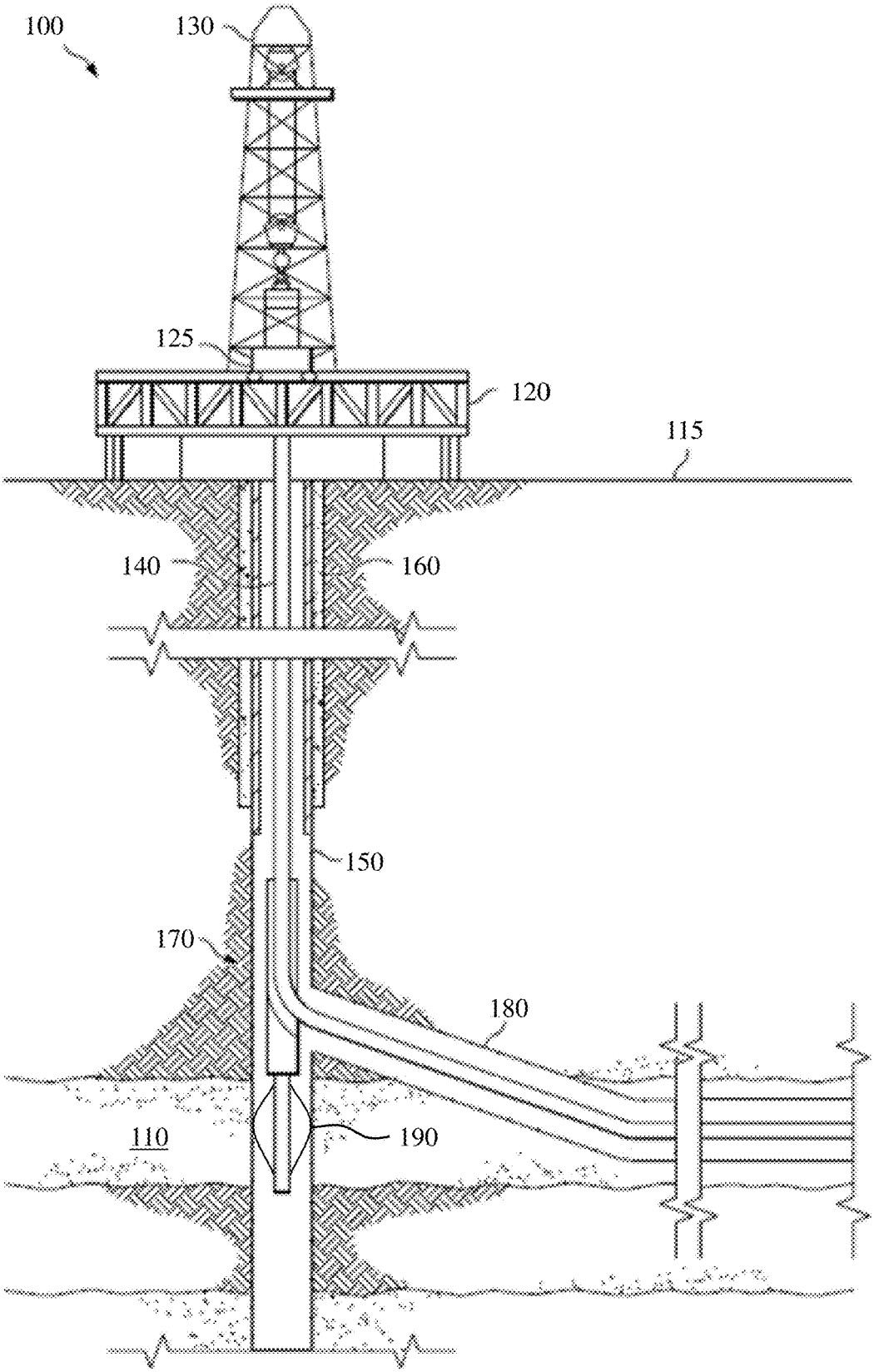
FIG. 1 illustrates a schematic view of a well system designed, manufactured and operated according to one or more embodiments disclosed herein.

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms.

Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to a direct interaction between the elements and may also include an indirect interaction between the elements described. Unless otherwise specified, use of the terms "up," "upper," "upward," "uphole," "upstream," or other like terms shall be construed as generally away from the bottom, terminal end of a well; likewise, use of the terms "down," "lower," "downward," "downhole," "downstream," or other like terms shall be construed as generally toward the bottom, terminal end of a well, regardless of the wellbore orientation. Use of any one or more of the foregoing terms shall not be construed as denoting positions along a perfectly vertical axis. Unless otherwise specified, use of the term "subterranean formation" shall be construed as encompassing both areas below exposed earth and areas below earth covered by water, such as ocean or fresh water.

The disclosure addresses the challenge of running a whipstock assembly on a mill, for example in an effort to reduce trip count. With this in mind, the present disclosure provides a two part drilling and running tool (e.g., including a smaller assembly and a larger bit assembly) that may be used to run a whipstock assembly downhole. In at least one embodiment, the larger bit assembly (e.g., uphole/larger bit assembly) is connected to the whipstock assembly, for example proximate an uphole end of the whipstock assembly. At a desired point in time, the smaller assembly may pull back uphole and connect to the larger bit assembly, thereby forming a new combined bit assembly (e.g., that looks and functions like a conventional lead mill). For purposes of the present disclosure, the term bit assembly is intended to encompass both mill assemblies and drill bit assemblies. Following the successful creation of the exit and the drilling of the lateral, the lateral completion could be installed and then tied together with the main bore by installing a junction (e.g., level 5 junction in one embodiment).

In accordance with at least one embodiment of the disclosure, the smaller assembly is a smaller bit assembly having one or more cutting features (e.g., teeth, blades, etc.) thereon. The smaller assembly, in one embodiment, could be connected to a conveyance that extends through the larger bit assembly and is then connected to the rest of the drill string, or perhaps to a downhole motor directly. In at least one embodiment, the smaller assembly is sized such that it can wholly or partially fit into a bore of the whipstock assembly, such that in one embodiment it may connect to the whipstock assembly or there below. In at least one embodiment, the larger bit assembly and/or smaller assembly are coupled to the whipstock assembly or other downhole device there below using a shear feature, a collection of lugs and/or slots or other connecting mechanism.

With the smaller assembly free from the whipstock assembly or other downhole device there below, the smaller assembly is free to slide back uphole and into the larger bit assembly. In one or more embodiments, the smaller assembly has a spline or slot located along an entire length ($L_S$) thereof, and the larger bit assembly includes an associated other of the slot or spline. In at least one embodiment, the spline or slot in the smaller assembly and the associated other of the slot or spline in the larger bit assembly are configured to engage one another to rotationally fix the smaller assembly relative to the larger bit assembly as the smaller assembly and the larger bit assembly slidingly engage one another to form the combined bit assembly. In one or more embodiments, the spline or slot in the smaller assembly is a spline and the other of the slot or spline in the larger bit assembly is a slot, but the opposite may also be true.

In one or more other embodiments, the spline or slot is a first smaller assembly spline or slot and the other of the slot or spline is a first larger bit assembly other of the slot or spline. In at least this embodiment, the smaller assembly has a second spline or slot located along less than the entire length ($L_S$) thereof, and the larger bit assembly has a second other of the slot or spline located along less than an entire length ($L_L$) thereof. In accordance with this embodiment, the second spline or slot is configured to engage with the second other of the slot or spline to prevent the smaller assembly from sliding out of the larger bit assembly as the conveyance is being retracted uphole.

Once the smaller assembly has been fully retracted into the larger bit assembly it can be secured to the larger bit assembly for the milling operation. In at least one embodiment, a simple snap ring falls into a groove in the smaller assembly, thereby securing (e.g., laterally securing) the smaller assembly within the larger bit assembly. Many alternate methods are possible, such as spring-loaded pins, locking dogs, or an interference fit between the two bit assemblies. In at least one embodiment, the spline or slot located in the smaller assembly and the other of the slot or spline located in the larger bit assembly rotationally lock the two bit assemblies together (e.g., torsionally securing the smaller assembly and the larger bit assembly), while the snap ring or other feature axially locks the two bit assemblies together.

At this point the larger bit assembly may be disconnected from the whipstock assembly tip and a normal window can be milled in the casing and/or formation as is current industry practice. As is sometimes the practice with milling windows, secondary mills (e.g., watermelon mills) may be added to follow the lead mill to ensure proper window geometry. Likewise multiple trips may be required to successfully mill a window. In those cases, extra mills or trips could be performed as is done today. Thereafter, the remainder of the multilateral construction may be completed, for example including placing a multilateral junction including a mainbore leg and a lateral bore leg at the junction between the main wellbore and the lateral wellbore.

Up to this point, the use of a two part drilling and running tool has been discussed for creating an exit window from a cased mainbore. An alternate use for this new technology is to sidetrack from an open-hole main bore. In this alternate use, the bit assembly would be more appropriately called a drill bit, as it would be drilling formation to exit the main bore rather milling casing. This would be useful for simple sidetracking where the main bore may need to be abandoned, or it may be used during the construction of an open-hole multilateral junction. In this use, the smaller assembly and larger bit assembly would be designed differently than what is shown here, for example to closely resemble a drill bit instead of a mill bit. This would necessitate certain changes to the external cutting features, which should be understood to not deviate from the core features described herein.

FIG. 1 is a schematic view of a well system 100 designed, manufactured and operated according to one or more embodiments disclosed herein. The well system 100 includes a platform 120 positioned over a subterranean formation 110 located below the earth's surface 115. The platform 120, in at least one embodiment, has a hoisting apparatus 125 and a derrick 130 for raising and lowering one or more downhole tools including one or more conveyance (e.g., pipe strings, such as a drill string 140). Although a land-based oil and gas platform 120 is illustrated in FIG. 1, the scope of this disclosure is not thereby limited, and thus could potentially apply to offshore applications. The teachings of this disclosure may also be applied to other land-based and/or water-based well systems different from that illustrated.

As shown, a main wellbore 150 has been drilled through the various earth strata, including the subterranean formation 110. The term "main" wellbore is used herein to designate a primary wellbore from which another secondary wellbore is drilled. It is to be noted, however, that a main wellbore 150 does not necessarily extend directly to the earth's surface, but could instead be a branch of yet another lateral wellbore. A casing string 160 may be at least partially cemented within the main wellbore 150. The term "casing" is used herein to designate a tubular string used to line a wellbore. Casing may actually be of the type known to those skilled in the art as a "liner" and may be made of any material, such as steel or composite material and may be segmented or continuous, such as coiled tubing. The term "lateral" wellbore is used herein to designate a wellbore that is drilled outwardly from its intersection with another wellbore, such as a main wellbore. Moreover, a lateral wellbore may have another lateral wellbore drilled outwardly therefrom.

A whipstock assembly 170 according to one or more embodiments of the present disclosure may be positioned at a location in the main wellbore 150. Specifically, the whipstock assembly 170 could be placed at a location in the main wellbore 150 where it is desirable for a lateral wellbore 180 to exit. Accordingly, the whipstock assembly 170 may be used to support a drilling/milling tool used to penetrate a window in the main wellbore 150. In at least one embodiment, once the window has been milled and a lateral wellbore 180 formed, the whipstock assembly 170 may be retrieved and returned uphole by a retrieval tool, in some embodiments in only a single trip.

In some embodiments, an anchoring assembly 190 may be placed downhole in the wellbore 150 to support and anchor downhole tools, such as the whipstock assembly 170, for keeping the whipstock assembly 170 in place while milling the casing 160 and/or drilling the lateral wellbore 180. The anchoring assembly 190, in accordance with the disclosure, may be employed in a cased section of the main wellbore 150, or may be located in an open-hole section of the main wellbore 150, as is shown. As such, the anchoring assembly 190 in at least one embodiment may be configured to resist at least 6,750 newton meters (Nm) (e.g., about 5,000 lb-ft) of torque. In yet another embodiment, the anchoring assembly 190 may be configured to resist at least 13,500 newton meters (Nm) (e.g., about 10,000 lb-ft) of torque, and in yet another embodiment configured to resist at least 20,250 newton meters (Nm) (e.g., about 15,000 lb-ft) of torque. Similarly, the anchoring assembly 190 may be configured to resist at least 1814 kg (e.g., about 4,000 lb) of axial force. In yet another embodiment, the anchoring assembly 190 may be configured to resist at least 4536 kg (e.g., about 10,000 lb) of axial force, and in yet another embodiment the anchoring assembly 190 may be configured to resist at least 6804 kg (e.g., about 15,000 lb) of axial force.

In the illustrated embodiment, the anchoring assembly 190 may be a hydraulically activated anchoring assembly. In this embodiment, once the anchoring assembly 190 reaches a desired location in the main wellbore 150, fluid pressure may be applied to set the hydraulic anchoring assembly. In at least one embodiment, the hydraulically activated anchoring assembly includes two or more hydraulic activation chambers, and the activation fluid is supplied to the two or more hydraulic activation chambers (e.g., through a two-part milling assembly coupled to the whipstock assembly 170) to move the two or more hydraulic activation chambers from the first collapsed state to the second activated state and engage a wall of the main wellbore 150. The anchoring assembly 190 may also include, in some embodiments, an expandable medium positioned radially about the two or more hydraulic activation chambers. In some aspects, the expandable medium may be configured to grip and engage the wall of the main wellbore 150 when the two or more hydraulic activation chambers are in the second activated state. Notwithstanding, other fluid activated anchoring assemblies (e.g., other than those having two or more hydraulic activation chambers) may be used and remain within the scope of the disclosure. In at least one other embodiment, the hydraulically activated anchoring assembly includes one or more hydraulic activation slips, and the activation fluid is supplied to the one or more hydraulic activation slips (e.g., through a two-part milling assembly coupled to the whipstock assembly 170) to move the one or more hydraulic activation slips from the first collapsed state to the second activated state and engage the wall of the main wellbore 150.

Furthermore, mechanical activated anchoring assemblies could also be used and remain within the scope of the disclosure. For instance, in yet other embodiments, the anchoring assembly 190 is a latch coupling. In this embodiment, the latch coupling (e.g., a profile in the casing engages with a reciprocal profile in the whipstock assembly 170) anchors the whipstock assembly 170, and any other features hanging there below (e.g., screens, valves, etc.) in the casing string 160. Once the anchoring assembly 190 reaches a desired location in the main wellbore 150, the reciprocal profile in the whipstock assembly 170 may be activated to engage with the latch coupling profile in the casing string 160, thereby setting the anchoring assembly 190. Thus, in at least one embodiment, the anchoring assembly 190 is not hydraulically activated, but is mechanically activated.

In at least one embodiment, a multilateral junction is positioned at an intersection between the resulting main wellbore 150 and the resulting lateral wellbore 180. In accordance with one embodiment, the multilateral junction might include a main bore leg forming a first pressure tight seal with the main bore completion and a lateral bore leg forming a second pressure tight seal with the lateral bore completion, such that the main bore completion and the lateral bore completion are hydraulically isolated from one another. What results, in one or more embodiments, is an open hole TAML Level 5 pressure tight junction.

Figure 2A:
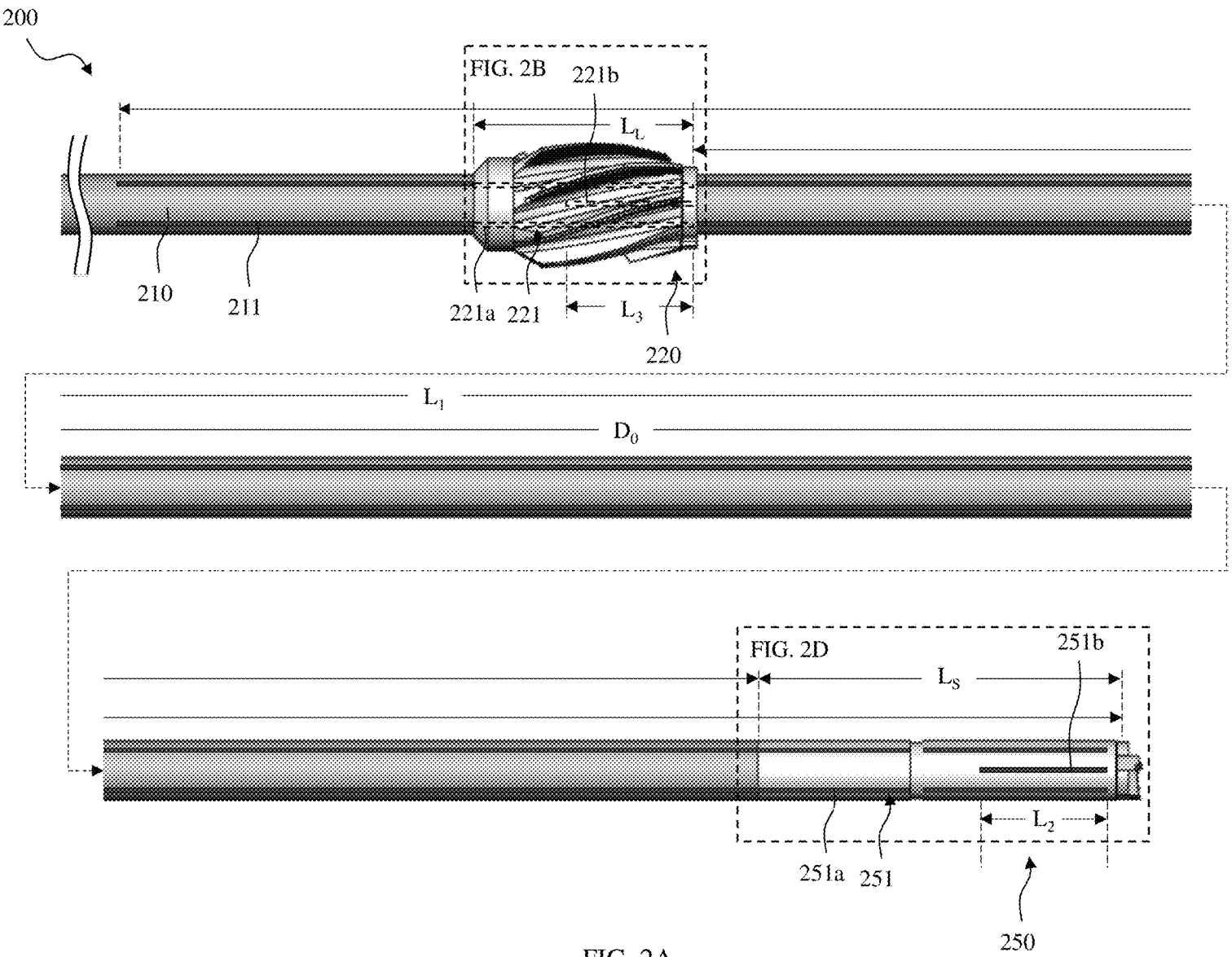
FIGS. 2A through 7B illustrate various different views of a two part milling and running tool designed, manufactured and operated according to one or more embodiments of the disclosure.
Figure 2B:
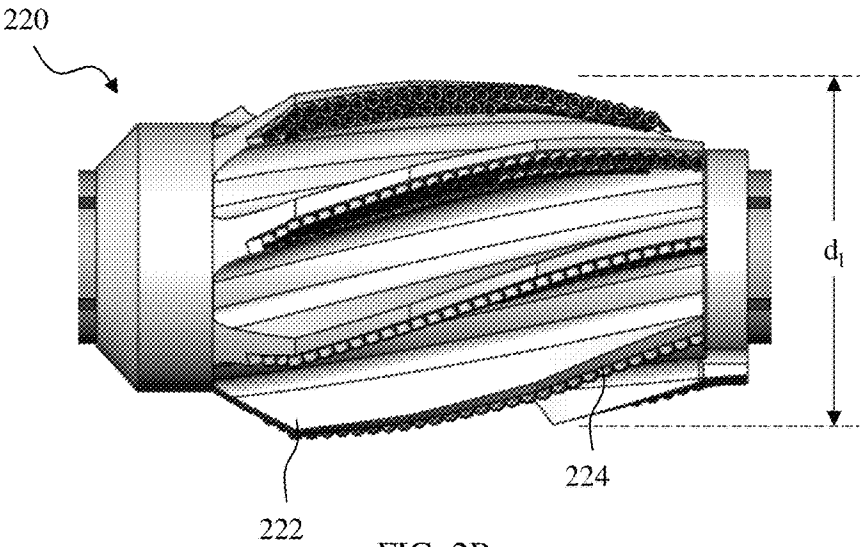
Figure 2C:
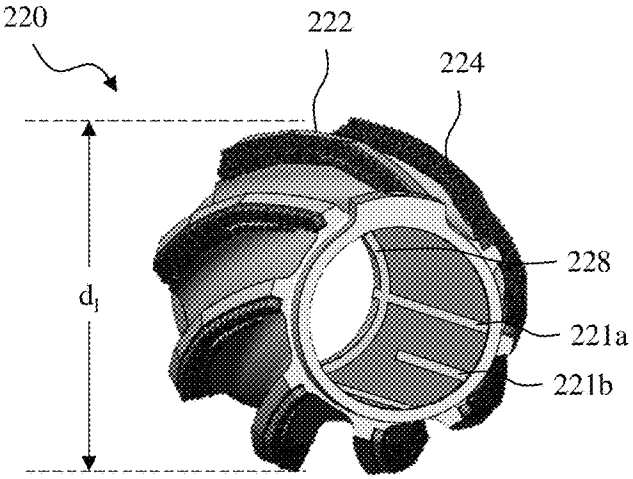
Figure 2D:
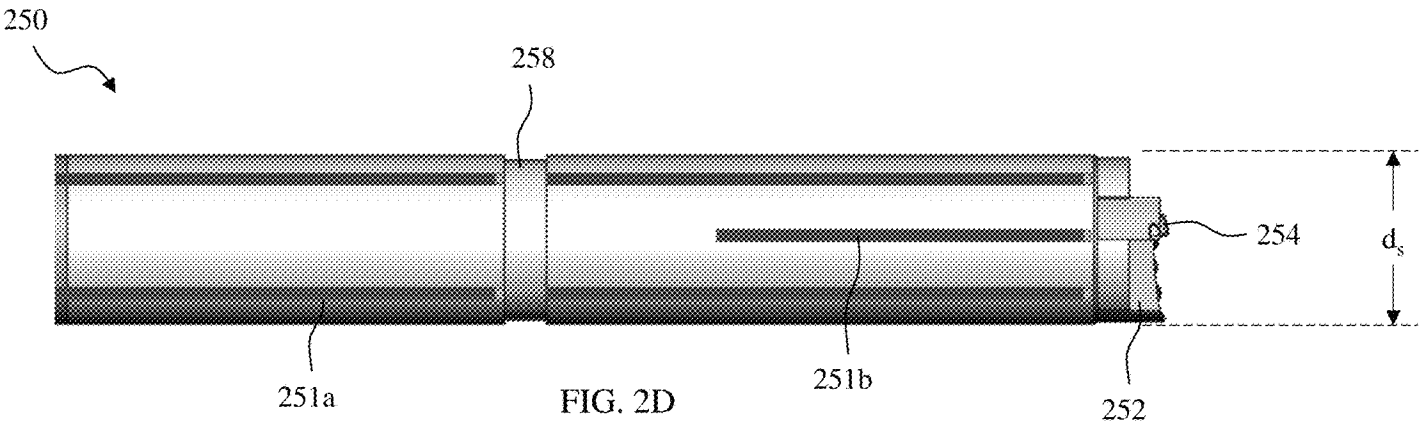
Figure 2E:
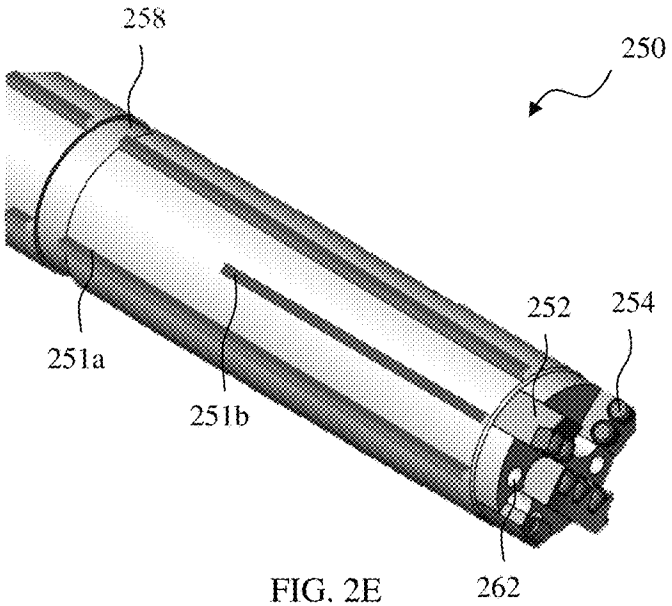

Turning now to FIGS. 2A through 2E, illustrated are various different views of a two part milling and running tool 200 designed, manufactured and operated according to one or more embodiments of the disclosure. FIG. 2A illustrates a side view of the two part milling and running tool 200. FIG. 2B illustrates an enlarged side view of the larger bit assembly of FIG. 2A. FIG. 2C illustrates an isometric view of one embodiment of an internal profile of the larger bit assembly of FIG. 2A. FIG. 2D illustrates an enlarged side view of the smaller assembly of FIG. 2A. FIG. 2E illustrates an isometric view of one embodiment of the smaller assembly of FIG. 2A.

With initial reference to FIG. 2A, the two part milling and running tool 200, in the illustrated embodiment, includes a conveyance 210. The conveyance 210, in at least one embodiment, is a tubular, such as jointed pipe or coiled tubing. The two part milling and running tool 200, as shown in the embodiment of FIGS. 2A through 2E, may additionally include a larger bit assembly 220 and a smaller assembly 250 coupled thereto. As indicated above, the phrase "bit assembly," as used herein, is intended to include both milling assemblies (e.g., as might be used to mill through casing) and drill bit assemblies (e.g., as might be used to drill through formation), as well as any combination of the two. As discussed above, and shown in many FIGS., the smaller assembly 250 may also be a smaller bit assembly, and thus may contain one or more different types of cutting features along a downhole face thereof.

In the illustrated embodiment of FIGS. 2A through 2E, the smaller assembly 250 is coupled to an end (e.g., coupled proximate, such as within 2 meters, if not within 1 meter, if not within .5 meters, if not within .1 meters, a downhole end) of the conveyance 210, whereas the larger bit assembly 220 is in sliding engagement with the conveyance 210. Accordingly, assuming that something (e.g., friction, a shear feature, etc.) is holding the larger bit assembly 220 in place as the conveyance 210 is moved, the smaller assembly 250 may slide relative to the larger bit assembly 220. For instance, if the conveyance 210 were withdrawn uphole, the larger bit assembly 220 would slide along the conveyance 210, thereby allowing the smaller assembly 250 to slide toward the larger bit assembly 220.

As will be discussed in greater detail below, the two part milling and running tool 200 may be used to deploy a whipstock assembly, and thus may be coupled to the whipstock assembly when running downhole. Accordingly, the smaller assembly 250 may be coupled to one of the whipstock assembly, the anchoring assembly or the wellbore liner, in at least one embodiment, which would prevent the smaller assembly 250 from sliding toward the larger bit assembly 220 during the run-in-hole phase. Only when the smaller assembly 250 is decoupled from the whipstock assembly, the anchoring assembly or the wellbore liner, would the smaller assembly 250 be allowed to slide toward the larger bit assembly 220.

In the illustrated embodiment, the smaller assembly 250 has a spline or slot 251 located along an entire length ($L_S$) thereof, and the larger bit assembly 220 has an associated other of a slot or spline 221. For example, when the spline or slot 251 is a spline, the other of the slot or spline 221 would be a slot. Alternatively, when the spline or slot 251 is a slot, the other of the slot or spline 221 would be a spline. In at least one embodiment, the length ($L_S$) is at least 0.1 meters, if not at least .2 meters. In yet another embodiment, the length ($L_S$) is at least 0.5 meters if not at least 1 meter.

In one or more embodiments, the spline or slot 251 is a smaller assembly spline or slot 251*a* and the other of the slot or spline 221 is a larger bit assembly other of the slot or spline 221*a*. In such an embodiment, the conveyance 210 may include a conveyance spline or slot 211 located along a length ($L_1$) of the conveyance and substantially aligned with the smaller assembly spline or slot 251*a*. The term "substantially aligned," as used in this paragraph, means that the conveyance spline or slot 211 and the smaller assembly spline or slot 251*a* are radially aligned within 3 degrees. In certain embodiments, the conveyance spline or slot 211 and the smaller assembly spline or slot 251*a* are ideally radially aligned within 2 degrees, or extremely radially aligned within 1 degree. In at least one embodiment, the conveyance spline or slot 211 and the smaller assembly spline or slot 251*a* are identically radially aligned. In at least this one embodiment, the conveyance spline or slot 211 and the larger bit assembly other of the slot or spline 221*a* are configured to engage one another to rotationally fix the conveyance 210 relative to the larger bit assembly 220. In one or more embodiments, the length ($L_1$) is at least 1 meter, if not at least 2 meters. In yet another embodiment, the length ($L_1$) is at least 4 meters, if not at least 5 meters or 8 meters or more.

In one or more embodiments, the spline or slot 251 is a first smaller assembly spline or slot 251*a* and the other of the slot or spline 221 is a first larger bit assembly other of the slot or spline 221*a*, and the smaller assembly 250 has a second spline or slot 251*b* located along less than the entire length ($L_S$) thereof, and the larger bit assembly 220 has a second other of the slot or spline 221*b* located along less than an entire length ($L_L$) thereof. In one or more embodiments, the second spline or slot 251*b* and the second other of the slot or spline 221*b* are located at a downhole end of the smaller assembly 250 and the larger bit assembly 220, respectively. In this embodiment, the second spline or slot 251*b* is configured to engage with the second other of the slot or spline 221*b* to prevent the smaller assembly 250 from sliding out of the larger bit assembly 220 as the conveyance 210 is being retracted uphole.

In one or more embodiments, the second spline or slot 251*b* has a length ($L_2$) and the second other of the slot or spline 221*b* has a length ($L_3$), and further wherein the length ($L_2$) and the length ($L_3$) are substantially the same. The term "substantially the same," as used in this paragraph, means that the length ($L_2$) and the length ($L_3$) are within 25 percent of each other. In yet another embodiment, the length ($L_2$) and the length ($L_3$) are ideally the same, which means that the length ($L_2$) and the length ($L_3$) are within 10 percent of each other. In yet even another embodiment, the length ($L_2$) and the length ($L_3$) are extremely the same, which means that the length ($L_2$) and the length ($L_3$) are within 2 percent of each other. In yet even another embodiment, the length ($L_2$) and the length ($L_3$) are exactly the same, which means that the length ($L_2$) and the length ($L_3$) are within 0.5 percent of each other. In one last embodiment, the length ($L_2$) and the length ($L_3$) are identical.

Notwithstanding the foregoing, in at least one embodiment, the length ($L_2$) and the length ($L_3$) are less than 0.8 meters. In at least one other embodiment, the length ($L_2$) and the length ($L_3$) are less than 0.5 meters, if not less than 0.1 meters, if not less than 0.05 meters. In yet another embodiment, the length ($L_2$) and the length ($L_3$) are less than 75 percent of the length ($L_S$). In an even other embodiment, the length ($L_2$) and the length ($L_3$) are less than 50 percent of the length ($L_S$), if not less than 40 percent.

In the illustrated embodiment, the first smaller assembly spline or slot 251*a* and the first larger bit assembly other of the slot or spline 221*a* are rotationally offset from the second smaller assembly spline or slot 251*b* and the second larger bit assembly other of the slot or spline 221*b*, for example by at least 5 degrees. In yet another embodiment, the two are radially offset by at least 10 degrees, if not at least 15 degrees. In yet another embodiment, ones of the first smaller assembly spline or slot 251*a* and the first larger bit assembly other of the slot or spline 221*a* are positioned equal distance from the second smaller assembly spline or slot 251*b* and the second larger bit assembly other of the slot or spline 221*b*.

The embodiment of FIG. 2A only depicts two first smaller assembly spline or slots 251*a* and two first larger bit assembly other of the slot or spline 221*a*, as well as a single second smaller assembly spline or slot 251*b* and a single second larger bit assembly other of the slot or spline 221*b*. This is in part due to the view, but those skilled in the art understand that the two part drilling and running tool 200 might include any number of splines and/or slots, for examples anywhere from one to 10 first smaller assembly spline or slots 251*a* and one to 10 first larger bit assembly other of the slot or spline 221*a*, as well as anywhere from one to 10 second smaller assembly spline or slot 251*b* and one to 10 second larger bit assembly other of the slot or spline 221*b*.

In the illustrated embodiment of FIG. 2A, the two part milling and running tool 200 is positioned in the run-in-hole position. In this run-in-hole position, the larger bit assembly 220 would be spaced apart from the smaller assembly 250 by a distance ($D_0$). In at least one embodiment, the distance ($D_0$) approximates the length of the whipstock assembly that the two part milling and running tool 200 is coupled to. According to this embodiment, the smaller assembly 250 might couple proximate a downhole end of the whipstock assembly, whereas the larger bit assembly 220 might couple proximate an uphole end of the whipstock assembly. Thus, in at least one embodiment, the distance ($D_0$) is at least 1 meter, or at least 2 meters. In yet another embodiment, the distance ($D_0$) is at least 4 meters, and in even another embodiment the distance ($D_0$) is at least 5 meters. In at least one other embodiment, the distance ($D_0$) approximates the length of the whipstock assembly and at least a portion of the length of the anchoring assembly. In at least yet another embodiment, the distance ($D_0$) approximates the length of the whipstock assembly, the length of the anchoring assembly, and at least a portion of the length of the wellbore liner.

Turning now to FIG. 2B, the larger bit assembly 220 may have one or more blades 222 and/or one or more cutting features 224 thereon. While specific blades 222 and cutting features 224 are illustrated in FIG. 2B, any currently known or hereafter discovered blades and cutting features may be used and remain within the scope of the disclosure. The larger bit assembly 220, in the illustrated embodiment, includes a cutting diameter ($d_1$). In at least one embodiment, the cutting diameter ($d_1$) approximates the size of an opening (e.g., in the casing and/or formation) forming a lateral wellbore.

Turning now to FIG. 2C, in at least one embodiment, the larger bit assembly 220 may also include a lock ring profile 228, which may be configured to hold a lock ring (not shown) that could ultimately engage with an associated lock ring profile in the smaller assembly 250, or vice versa.

Turning now to FIG. 2D, the smaller assembly 250 may have one or more blades 252 and one or more cutting features 254 thereon, thereby making the smaller assembly 240 a smaller bit assembly. While specific blades 252 and cutting features 254 are illustrated in FIG. 2D, any currently known or hereafter discovered blades and cutting features may be used and remain within the scope of the disclosure. The smaller assembly 250, in the illustrated embodiment, includes a cutting diameter ($d_s$). In at least one embodiment, the cutting diameter ($d_s$) is at least 10 percent less than the cutting diameter ($d_1$). In at least one embodiment, the cutting diameter ($d_s$) is at least 25 percent less than the cutting diameter ($d_1$), in yet another embodiment at least 50 percent less than the cutting diameter ($d_1$), in yet another embodiment at least 75 percent less than the cutting diameter ($d_1$), and in yet another embodiment at least 90 percent less than the cutting diameter ($d_1$).

The smaller assembly 250, in the illustrated embodiment, may further include an associated lock ring profile 258. Accordingly, the lock ring profile 258, as well as the associated lock ring profile 228 and lock ring (not shown) of the larger bit assembly 220, may be used to linearly fix the larger bit assembly 220 and the smaller assembly 250. Additionally, the first smaller assembly spline or slot 251*a* of the smaller assembly 250, as well as the first larger bit assembly other of the slot or spline 221*a* of the larger bit assembly 220, may be used to rotationally fix the larger bit assembly 220 and the smaller assembly 250.

Turning now to FIG. 2E, the smaller assembly 250 may additionally include one or more fluid ports 262. The one or more fluid ports 262, in the illustrated embodiment, may provide fluid access past the smaller assembly 250, to help cool the bit/mill, lubricate and remove cuttings. In yet another embodiment, the one or more fluid ports 262, provide fluid access past the smaller assembly 250, particularly, when the smaller assembly 250 is coupled to and sealed with the whipstock assembly. For example, the one or more fluid ports 262 may be fluidly coupled with a through bore in the whipstock assembly, and thus may be used to activate a hydraulic wellbore anchoring assembly, among other downhole features.

Figure 3A:
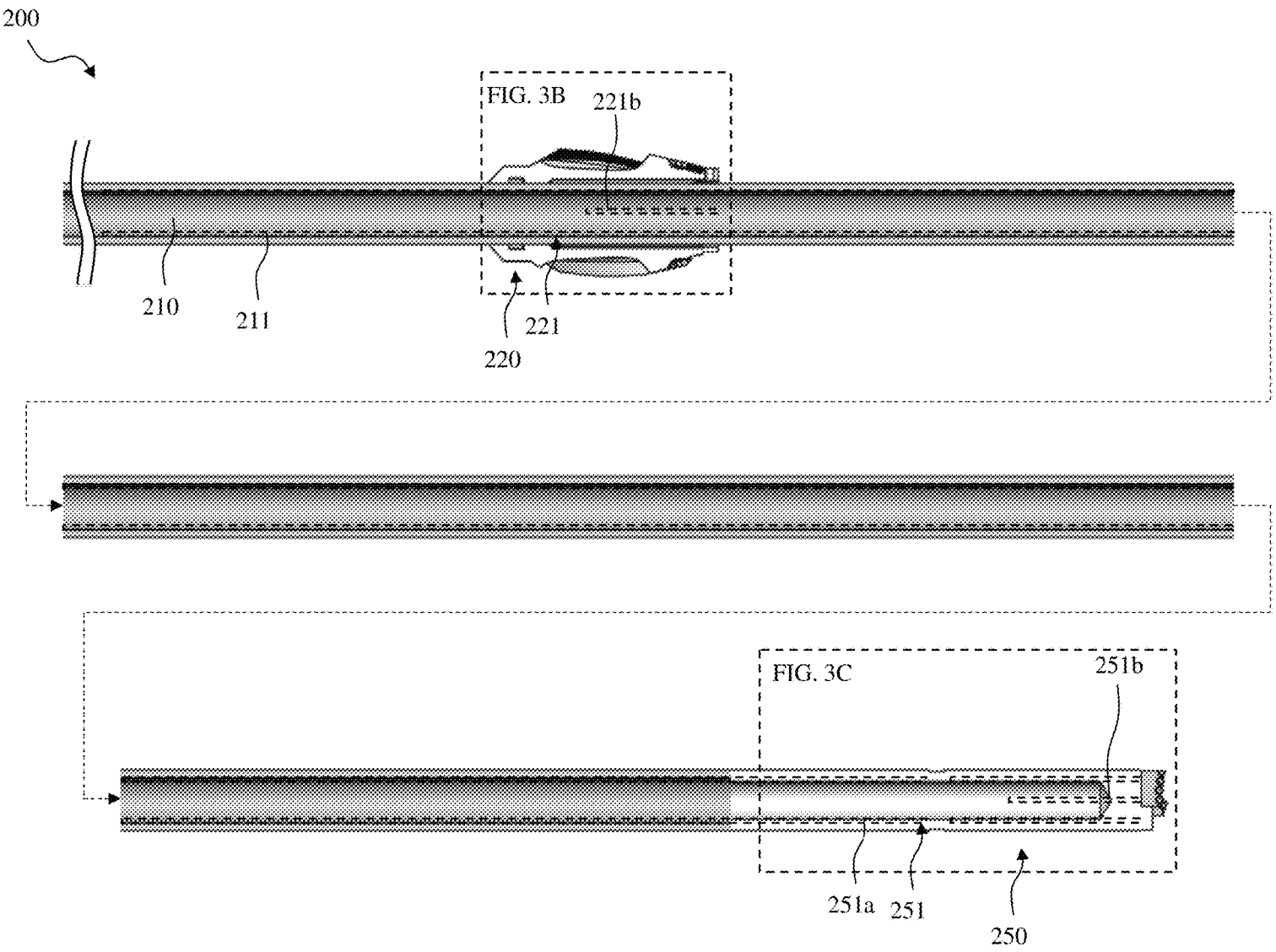

Turning to FIG. 3A, illustrated is a cross-sectional side view of the two part milling and running tool 200 of FIG. 2A.

Figure 3B:
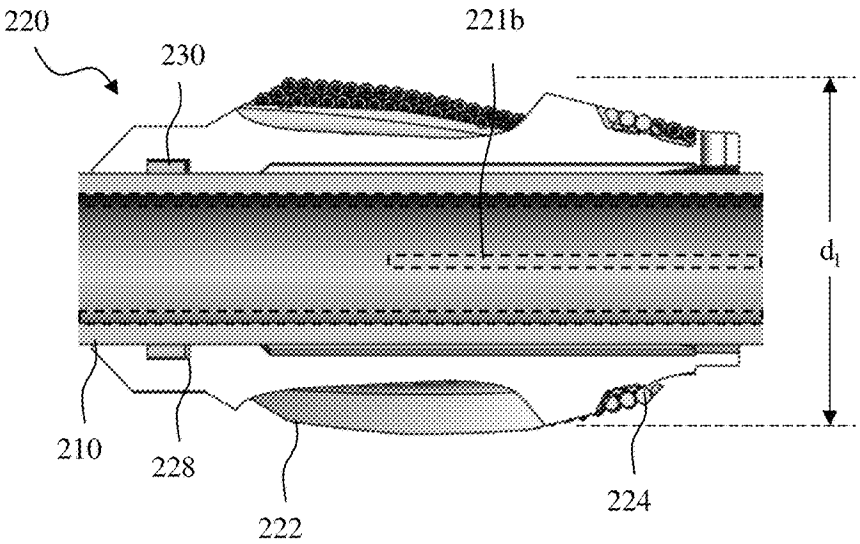

Turning now to FIG. 3B, illustrated is an enlarged side view of the larger bit assembly 220 of FIG. 3A. As can be seen in FIG. 3B, a lock ring 230 may be positioned within the lock ring profile 228, and surrounding the conveyance 210. As the conveyance 210 does not have a corresponding lock ring profile in the embodiment shown, the larger bit assembly 220 is allowed to slide along the conveyance 210 freely.

Figure 3C:
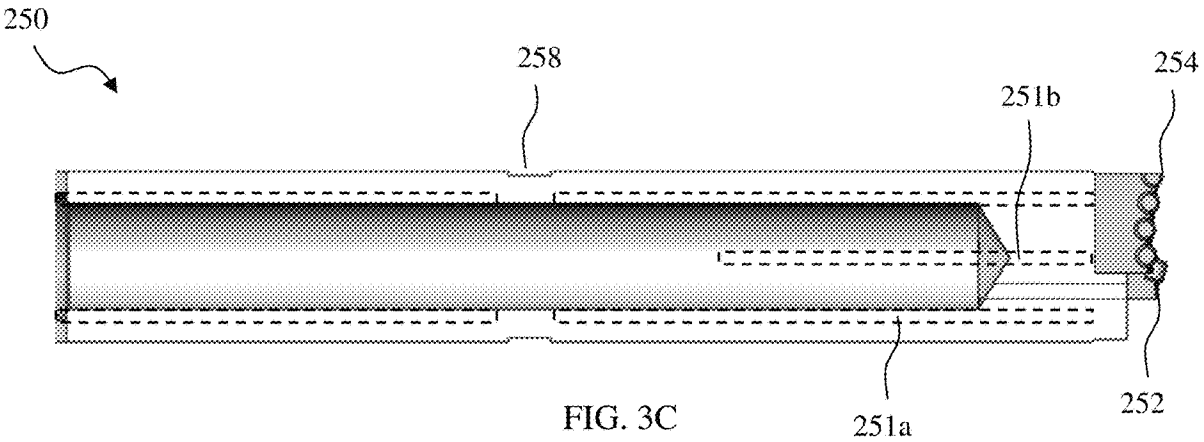

Turning now to FIG. 3C, illustrated is an enlarged side view of the smaller assembly 250 of FIG. 3A.

Figure 4:
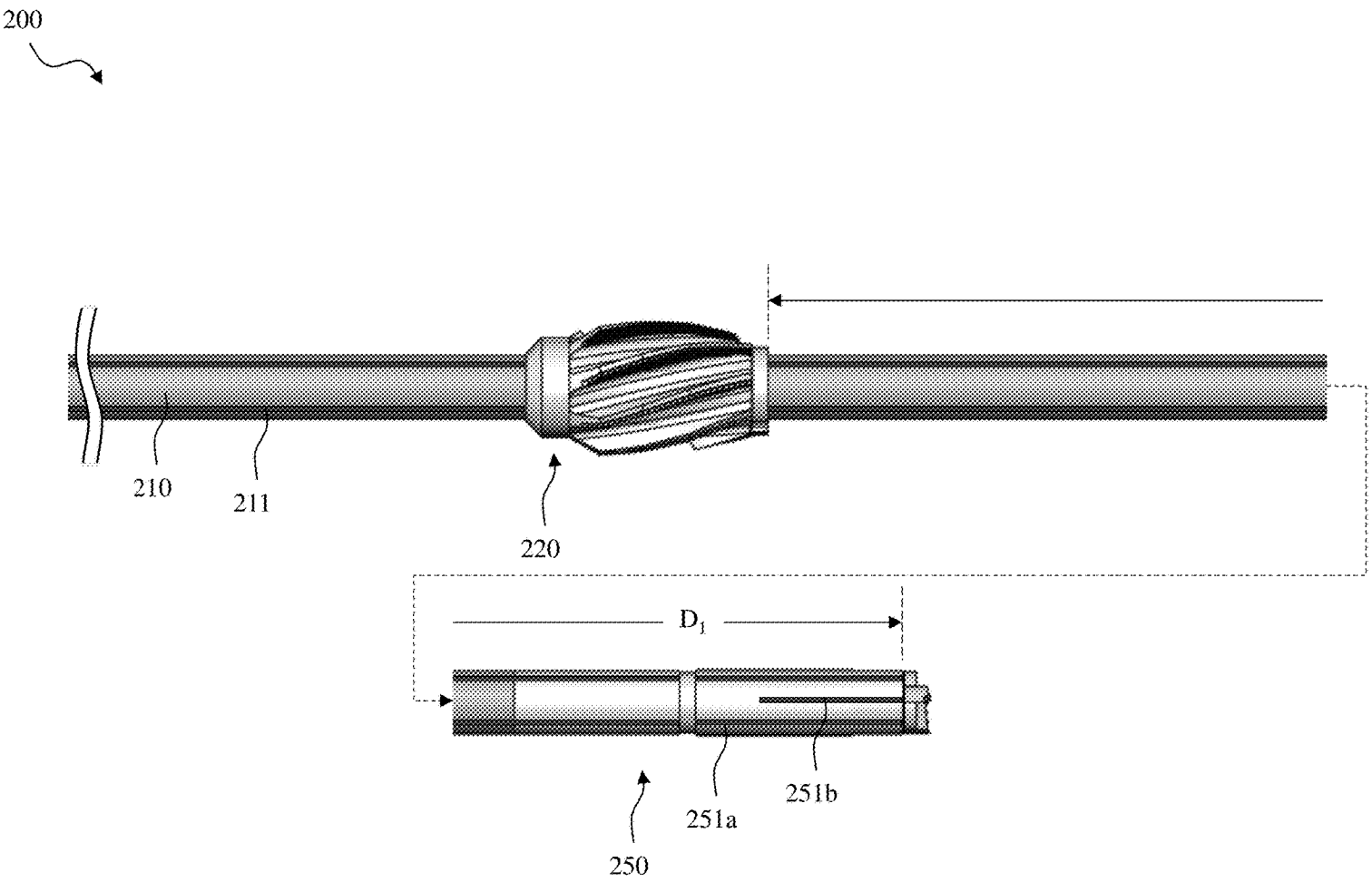

Turning to FIG. 4, illustrated is a side view of a two part milling and running tool 200 of FIGS. 2A and 3A, after the conveyance 210 has been pulled partially uphole, thereby sliding the smaller assembly 250 toward the larger bit assembly 220. In the illustrated embodiment, it is assumed that the larger bit assembly 220 is fixed in location, and that the smaller assembly 220 is sliding toward the fixed larger bit assembly 220. Such would be the case if the larger bit assembly 220 were still fixed (e.g., via friction, a shear feature, etc.) relative to the whipstock assembly. In this partially slid position, the larger bit assembly 220 would be spaced apart from the smaller assembly 250 by a distance ($D_1$). In at least one embodiment, the distance ($D_1$) is at least 50 percent less than the distance ($D_0$).

Figure 5:
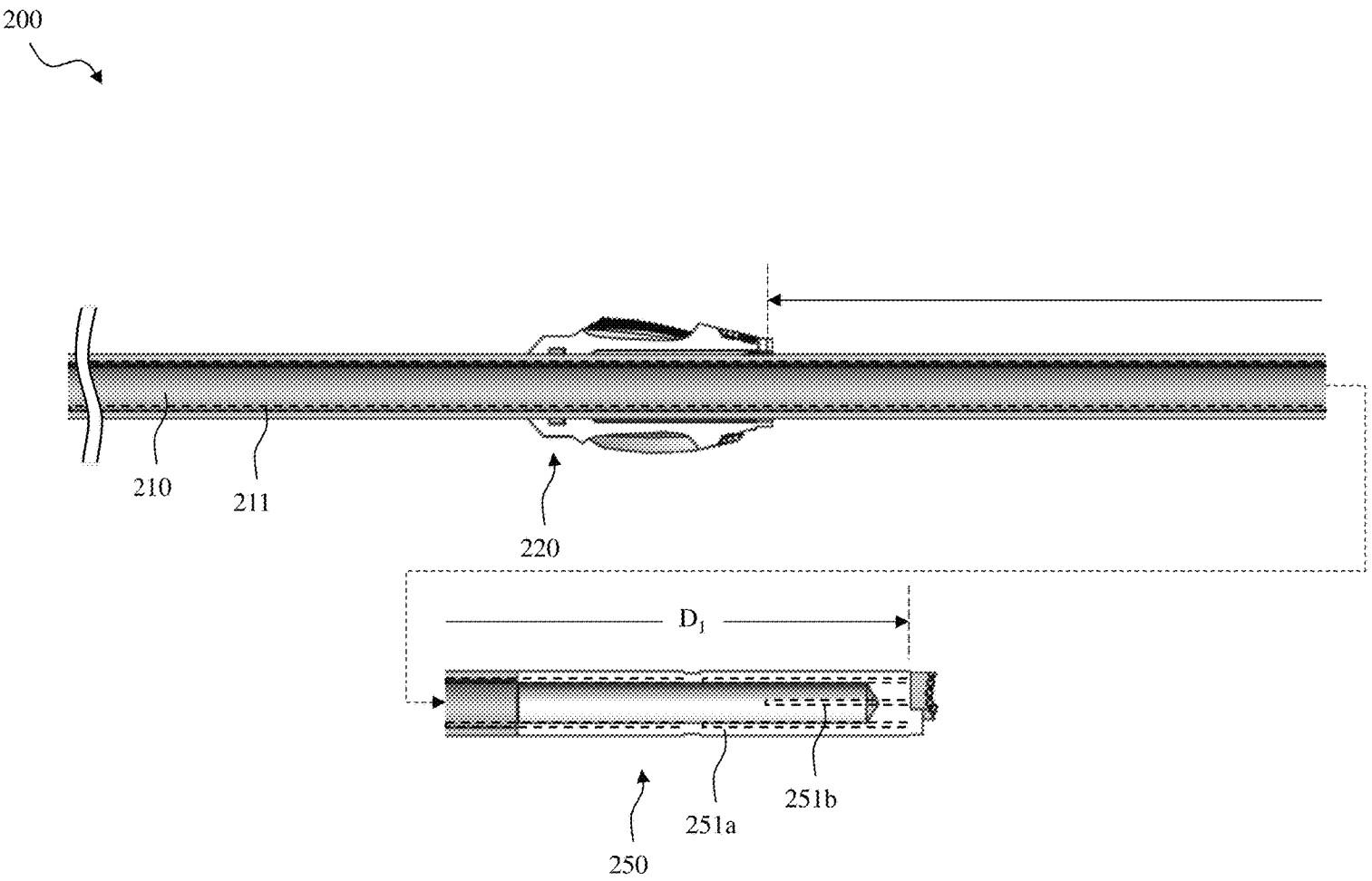

Turning to FIG. 5, illustrated is a cross-sectional side view of the two part milling and running tool 200 of FIG. 4.

Figure 6A:
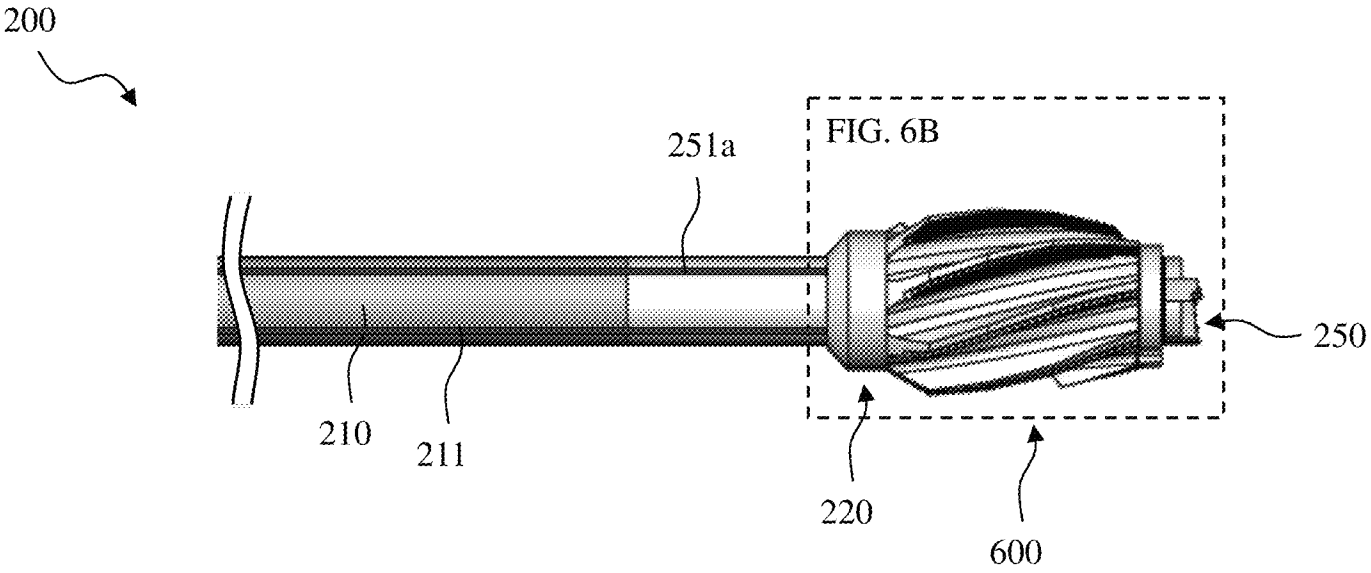

Turning to FIG. 6A, illustrated is a side view of a two part milling and running tool 200 of FIGS. 4 and 5, after the conveyance 210 has been pulled fully uphole, thereby sliding the smaller assembly 250 into engagement with the larger bit assembly 220, and thus forming a combined bit assembly 600.

Figure 6B:
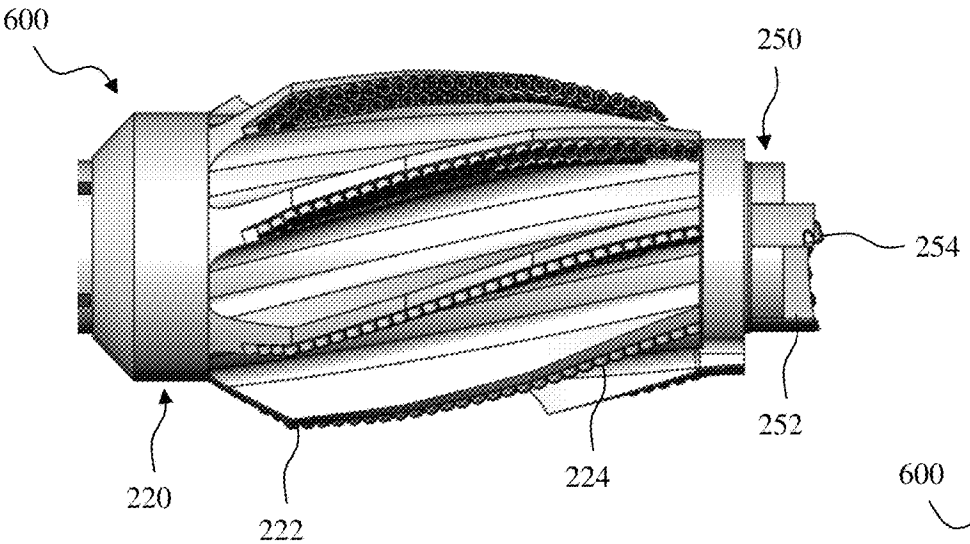

Turning now to FIG. 6B, illustrated is an enlarged side view of the combined bit assembly 600 of FIG. 6A. As shown, the smaller assembly 250 is engaged with the larger bit assembly 220. Furthermore, with the smaller assembly 250 engaged with the larger bit assembly 220, the combined bit assembly 600 may now approximate the shape of bit assemblies currently existing in the art.

Figure 6C:
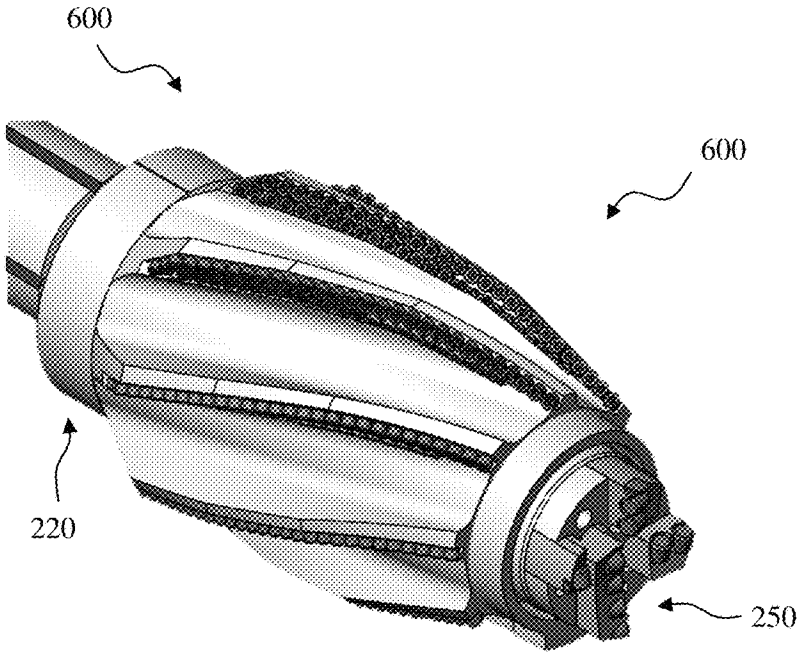

Turning now to FIG. 6C, illustrated is an isometric enlarged side view of the combined bit assembly 600 of FIG. 6A.

Figure 7A:
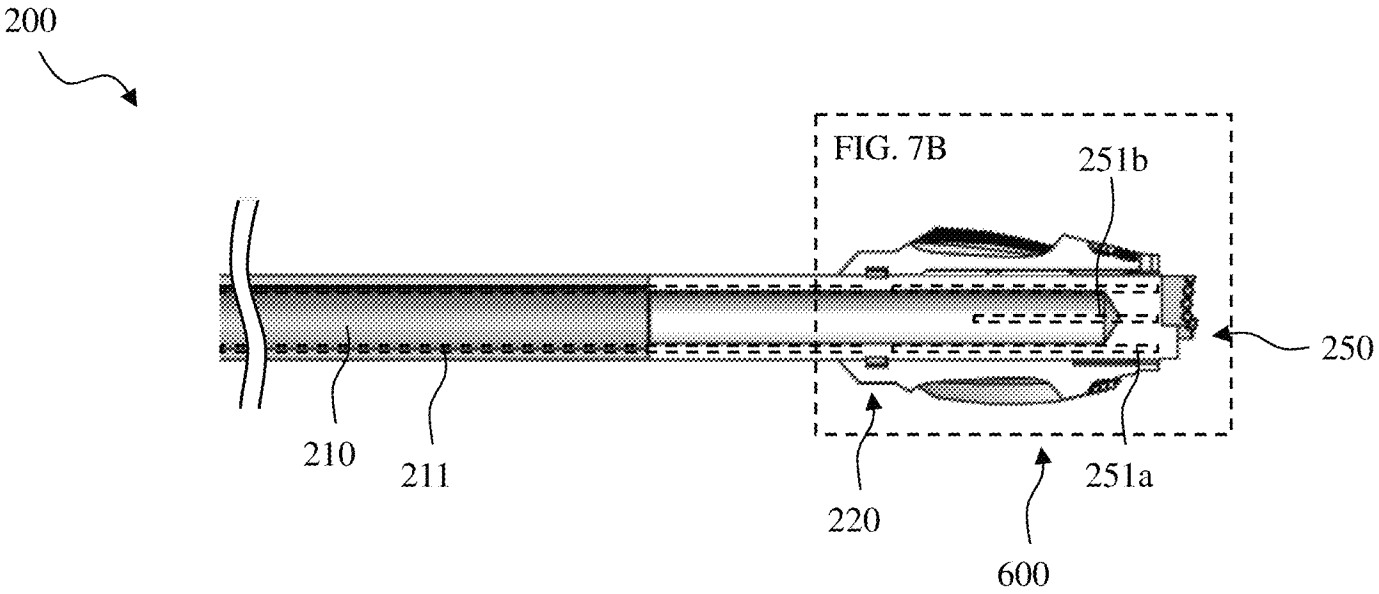

Turning to FIG. 7A, illustrated is a cross-sectional side view of a two part milling and running tool 200 of FIGS. 4 and 5, after the conveyance 210 has been pulled fully uphole, thereby sliding the smaller assembly 250 into engagement with the larger bit assembly 220, thereby forming the combined bit assembly 600.

Figure 7B:
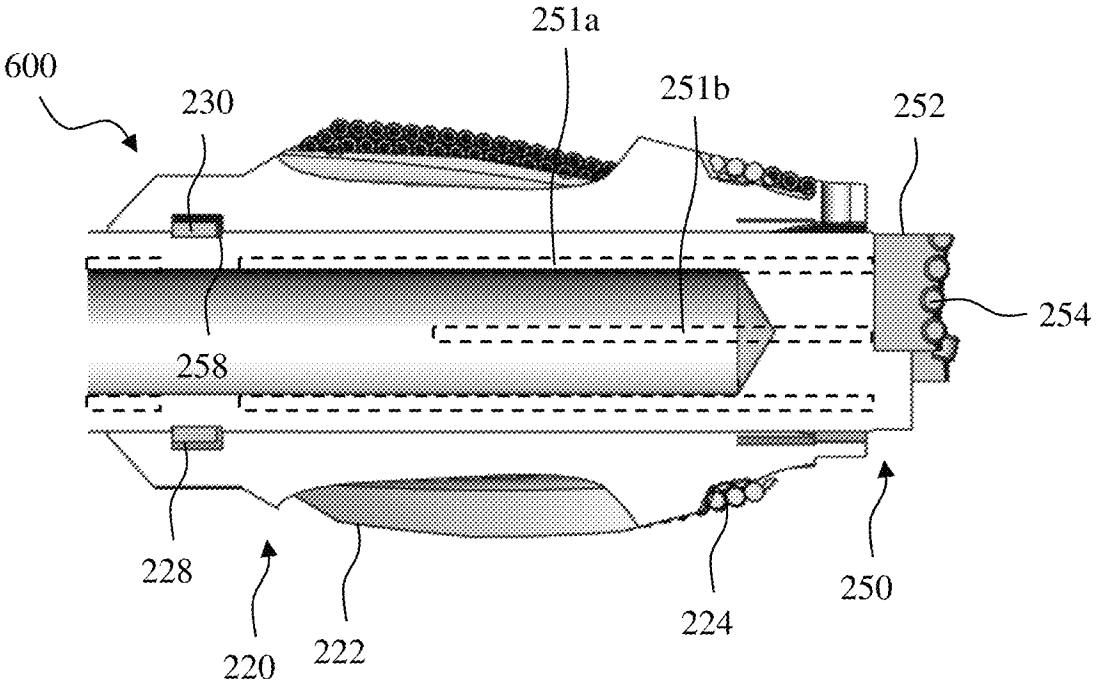

Turning now to FIG. 7B, illustrated is an enlarged cross-sectional side view of the combined bit assembly 600 of FIG. 7A. As shown in FIG. 7B, the lock ring 230 may snap into the associated lock ring profile 258 in the smaller assembly 250, and thus axially fix the smaller assembly 250 relative to the larger bit assembly 220.

Figure 8:
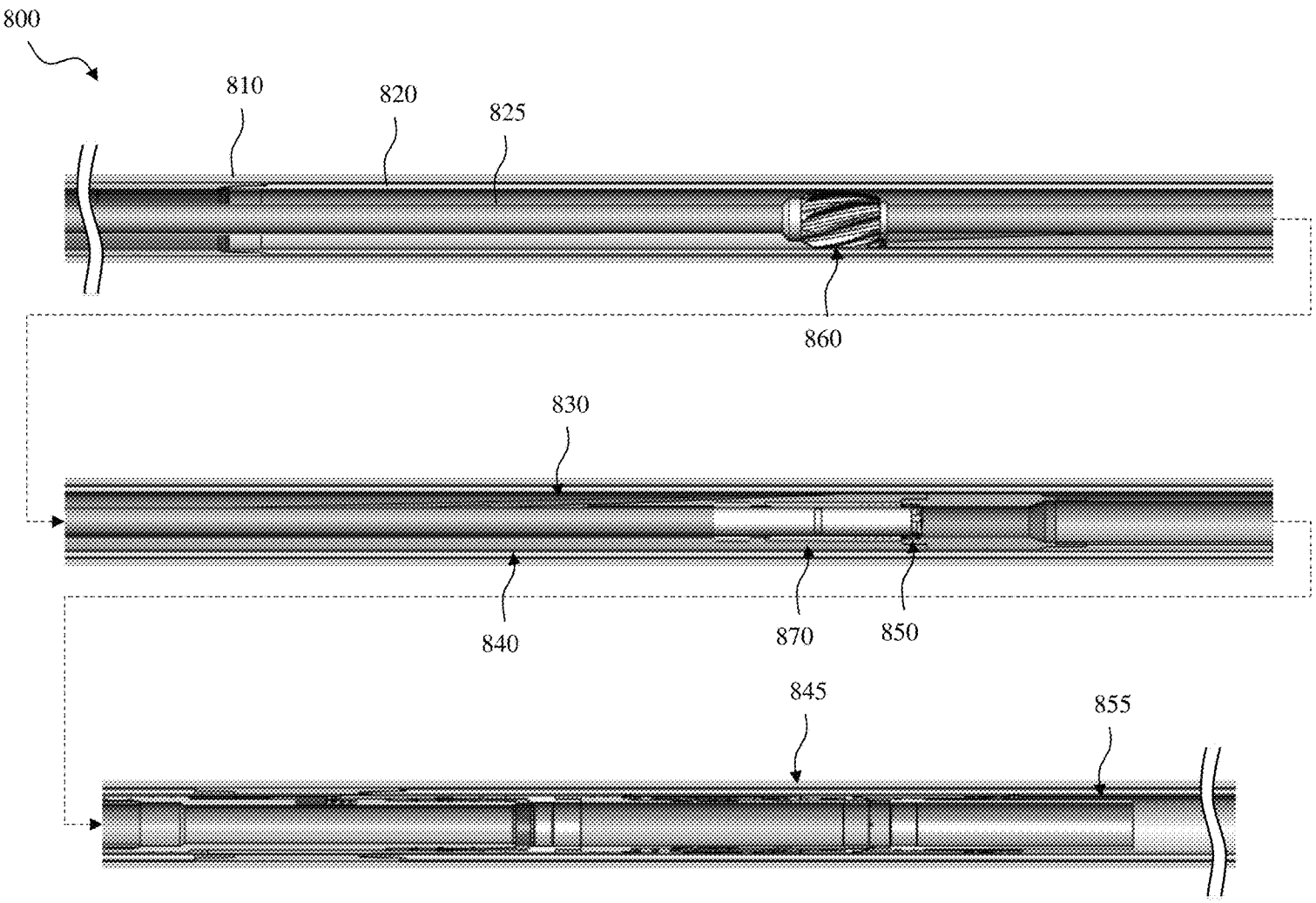
FIG. 8 illustrates various different views of a well system, the well system employing a two part drilling and running tool, for example to form a lateral wellbore therein.

Turning now to FIG. 8, illustrated is one embodiment of a well system 800, the well system 800 employing a two part drilling and running tool, for example to form a lateral wellbore therein. The well system 800 initially includes a main wellbore 810. As indicated above, the main wellbore 810 may be a primary wellbore extending from the surface, or a secondary wellbore already extending from a primary wellbore. Located in the main wellbore 810 is tubing string 820, such as casing string. In certain embodiment, while not shown, cement may be positioned between the main wellbore 810 and the tubing string 820. In the illustrated embodiment, a conveyance 825 and a two part drilling and running tool 830 are used to run a whipstock assembly 840 within the main wellbore 810. In at least one embodiment, the whipstock assembly 840 is coupled to an anchoring assembly 845 and a seal assembly 850 (e.g., smaller bit assembly sealing assembly), and thus the two part drilling and running tool 830 also runs the anchoring assembly 845 and the seal assembly 850 within the wellbore. In at least one embodiment, fluid supplied through the conveyance 825 and through the whipstock assembly 840 acts upon the anchoring assembly 845 to move it from a first collapsed state to a second activated state, and thus secure the whipstock assembly 840 within the main wellbore 810.

In yet another embodiment, a wellbore liner 855 is coupled to a downhole end of the anchoring assembly 845, and thus may also be run in the wellbore 810 with the two part drilling and running tool 830. The wellbore liner 855, in at least one embodiment, might be a lower mainbore completion assembly that might include one or more screens, one or more control valves, etc.

The two part drilling and running tool 830 may be similar to the two part drilling and running tool discussed above. Accordingly, the two part drilling and running tool 830 may include a larger bit assembly 860 and a smaller assembly 870. As shown in the embodiment of FIG. 8, the smaller assembly 870 is coupled to a downhole end of the conveyance 825, and extends at least partially within a through bore of the whipstock assembly 840.

Aspects disclosed herein include:

A. A two part drilling and running tool, the two part drilling and running tool including: 1) a conveyance; 2) a smaller assembly coupled to an end of the conveyance, the smaller assembly having a spline or slot located along an entire length ($L_S$) thereof; and 3) a larger bit assembly slidably coupled to the conveyance, the larger bit assembly including an other of the slot or spline, wherein the spline or slot in the smaller assembly and the other of the slot or spline in the larger bit assembly are configured to engage one another to rotationally fix the smaller assembly relative to the larger bit assembly as the smaller assembly and the larger bit assembly slidingly engage one another to form a combined bit assembly.

B. A downhole tool, the downhole tool including: 1) a two part drilling and running tool, including: a) a conveyance; b) a smaller assembly coupled to an end of the conveyance, the smaller assembly having a spline or slot located along an entire length ($L_S$) thereof; and c) a larger bit assembly slidably coupled to the conveyance, the larger bit assembly including an other of the slot or spline, wherein the spline or slot in the smaller assembly and the other of the slot or spline in the larger bit assembly are configured to engage one another to rotationally fix the smaller assembly relative to the larger bit assembly as the smaller assembly and the larger bit assembly slidingly engage one another to form a combined bit assembly; and 2) a whipstock assembly coupled to the two part drilling and running tool using a coupling mechanism.

C. A well system, the well system including: 1) a main wellbore located within a subterranean formation; and 2) a downhole tool positioned within the main wellbore, the downhole tool including: a) a two part drilling and running tool, the two part drilling and running tool including: i) a conveyance; ii) a smaller assembly coupled to an end of the conveyance, the smaller assembly having a spline or slot located along an entire length ($L_S$) thereof; and iii) a larger bit assembly slidably coupled to the conveyance, the larger bit assembly including an other of the slot or spline, wherein the spline or slot in the smaller assembly and the other of the slot or spline in the larger bit assembly engage one another to rotationally fix the smaller assembly relative to the larger bit assembly as the smaller assembly and the larger bit assembly slidingly engage one another to form a combined bit assembly; and b) a whipstock assembly coupled to the two part drilling and running tool using a coupling mechanism.

D. A method for forming a well system, the method including: 1) forming a wellbore within a subterranean formation; 2) positioning a downhole tool within the wellbore, the downhole tool including: a) a two part drilling and running tool, the two part drilling and running tool including: i) a conveyance; ii) a smaller assembly coupled to an end of the conveyance, the smaller assembly having a spline or slot located along an entire length ($L_S$) thereof; and iii) a larger bit assembly slidably coupled to the conveyance, the larger bit assembly including an other of the slot or spline, wherein the spline or slot in the smaller assembly and the other of the slot or spline in the larger bit assembly engage one another to rotationally fix the smaller assembly relative to the larger bit assembly as the smaller assembly and the larger bit assembly slidingly engage one another to form a combined bit assembly; and b) a whipstock assembly coupled to the two part drilling and running tool using a coupling mechanism; 2) rotating the conveyance, the spline or slot in the smaller assembly and the other of the slot or spline in the larger bit assembly causing the whipstock assembly to rotate with the conveyance; and 3) retracting the smaller assembly uphole, the smaller assembly engaging with the larger bit assembly to form a combined bit assembly.

Aspects A, B, C and D may have one or more of the following additional elements in combination: Element 1: wherein the spline or slot is a smaller assembly spline or slot and the other of the slot or spline is a larger bit assembly other of the slot or spline, and further including a conveyance spline or slot located along a length ($L_1$) of the conveyance and substantially aligned with the smaller assembly spline or slot, the conveyance spline or slot and the larger bit assembly other of the slot or spline configured to engage one another to rotationally fix the conveyance relative to the larger bit assembly. Element 2: wherein the length ($L_1$) is at least 2 meters. Element 3: wherein the length ($L_1$) is at least 4 meters. Element 4: wherein the length ($L_S$) is at least 0.1 meters. Element 5: wherein the spline or slot is a first smaller assembly spline or slot and the other of the slot or spline is a first larger bit assembly other of the slot or spline, and further wherein the smaller assembly has a second spline or slot located along less than the entire length ($L_S$) thereof and the larger bit assembly has a second other of the slot or spline located along less than an entire length ($L_L$) thereof, the second spline or slot configured to engage with the second other of the slot or spline to prevent the smaller assembly from sliding out of the larger bit assembly as the conveyance is being retracted uphole. Element 6: wherein the second spline or slot has a length ($L_2$) and the second other of the slot or spline has a length ($L_3$), and further wherein the length ($L_2$) and the length ($L_3$) are substantially the same. Element 7: wherein the length ($L_2$) and the length ($L_3$) are less than 0.8 meters. Element 8: wherein the first smaller assembly spline or slot and the first larger bit assembly other of the slot or spline are rotationally offset from the second smaller assembly spline or slot and the second larger bit assembly other of the slot or spline by at least 15 degrees. Element 9: wherein the spline or slot in the smaller assembly is a spline and the other of the slot or spline in the larger bit assembly is a slot. Element 10: wherein the smaller bit assembly includes one of a lock ring profile or a lock ring, and the larger bit assembly includes an other of the lock ring or the lock ring profile, the lock ring profile and lock ring configured to engage with one another to slidingly fix the smaller bit assembly with the larger bit assembly when the two are slidingly engaged together. Element 11: wherein the smaller bit assembly includes the lock ring profile and the larger bit assembly includes the lock ring. Element 12: further including: an anchoring assembly coupled downhole of the whipstock assembly; and a wellbore liner coupled downhole of the anchoring assembly.

Those skilled in the art to which this application relates will appreciate that other and further additions, deletions, substitutions and modifications may be made to the described embodiments.

What is claimed is:

1. A two part drilling and running tool, comprising:

a conveyance;

a smaller assembly having a length LS coupled to an end of the conveyance, the smaller assembly having a smaller assembly spline or slot located along an entirety of the length LS; and a larger bit assembly slidably coupled to the conveyance, the larger bit assembly including a larger bit assembly other of the slot or spline, wherein the smaller assembly spline or slot and the larger bit assembly other of the slot or spline are configured to engage one another to rotationally fix the smaller assembly relative to the larger bit assembly as the smaller assembly and the larger bit assembly slidingly engage one another to form a combined bit assembly, and further including a conveyance spline or slot located along a length L1 of the conveyance and substantially aligned with the smaller assembly spline or slot, the conveyance spline or slot and the larger bit assembly other of the slot or spline configured to engage one another to rotationally fix the conveyance relative to the larger bit assembly.

2. The two part drilling and running tool as recited in claim 1, wherein the length L1 is at least 2 meters.

3. The two part drilling and running tool as recited in claim 1, wherein the length L1 is at least 4 meters.

4. The two part drilling and running tool as recited in claim 1, wherein the length LS is at least 0.1 meters.

5. The two part drilling and running tool as recited in claim 1, wherein the smaller assembly spline or slot is a first smaller assembly spline or slot and the larger bit assembly other of the slot or spline is a first larger bit assembly other of the slot or spline, and further wherein the smaller assembly has a second spline or slot located along less than the entire length LS thereof and the larger bit assembly has a second other of the slot or spline located along less than an entire length LL thereof, the second spline or slot configured to engage with the second other of the slot or spline to prevent the smaller assembly from sliding out of the larger bit assembly as the conveyance is being retracted uphole.

6. The two part drilling and running tool as recited in claim 5, wherein the second spline or slot has a length L2 and the second other of the slot or spline has a length L3, and further wherein the length L2 and the length L3 are substantially the same.

7. The two part drilling and running tool as recited in claim 6, wherein the length L2 and the length L3 are less than 0.8 meters.

8. The two part drilling and running tool as recited in claim 7, wherein the first smaller assembly spline or slot and the first larger bit assembly other of the slot or spline are rotationally offset from the second smaller assembly spline or slot and the second larger bit assembly other of the slot or spline by at least 15 degrees.

9. The two part drilling and running tool as recited in claim 1, wherein the smaller assembly spline or slot is a spline and the larger bit assembly other of the slot or spline is a slot.

10. The two part drilling and running tool as recited in claim 1, wherein the smaller bit assembly includes one of a lock ring profile or a lock ring, and the larger bit assembly includes an other of the lock ring or the lock ring profile, the lock ring profile and lock ring configured to engage with one another to slidingly fix the smaller bit assembly with the larger bit assembly when the two are slidingly engaged together.

11. The two part drilling and running tool as recited in claim 10, wherein the smaller bit assembly includes the lock ring profile and the larger bit assembly includes the lock ring.

12. A downhole tool, comprising:

a two part drilling and running tool, including:

a conveyance;

a smaller assembly having a length LS coupled to an end of the conveyance, the smaller assembly having a smaller assembly spline or slot located along an entirety of the length LS thereof; and a larger bit assembly slidably coupled to the conveyance, the larger bit assembly including a larger bit assembly other of the slot or spline, wherein the smaller assembly spline or slot and the larger bit assembly other of the slot or spline are configured to engage one another to rotationally fix the smaller assembly relative to the larger bit assembly as the smaller assembly and the larger bit assembly slidingly engage one another to form a combined bit assembly; and a whipstock assembly coupled to the two part drilling and running tool.

13. The downhole tool as recited in claim 12, further including:

an anchoring assembly coupled downhole of the whipstock assembly; and a wellbore liner coupled downhole of the anchoring assembly.

14. The downhole tool as recited in claim 12, wherein the spline or slot is a smaller assembly spline or slot and the other of the slot or spline is a larger bit assembly other of the slot or spline, and further including a conveyance spline or slot located along a length ($L_1$) of the conveyance and substantially aligned with the smaller assembly spline or slot, the conveyance spline or slot and the larger bit assembly other of the slot or spline configured to engage one another to rotationally fix the conveyance relative to the larger bit assembly.

15. The downhole tool as recited in claim 14, wherein the length L1 is at least 2 meters.

16. The downhole tool as recited in claim 14, wherein the length L1 is at least 4 meters.

17. The downhole tool as recited in claim 12, wherein the length LS is at least 0.1 meters.

18. The downhole tool as recited in claim 12, wherein the smaller assembly spline or slot is a first smaller assembly spline or slot and the larger bit assembly other of the slot or spline is a first larger bit assembly other of the slot or spline, and further wherein the smaller assembly has a second spline or slot located along less than the entire length LS thereof and the larger bit assembly has a second other of the slot or spline located along less than an entire length LL thereof, the second spline or slot configured to engage with the second other of the slot or spline to prevent the smaller assembly from sliding out of the larger bit assembly as the conveyance is being retracted uphole.

19. The downhole tool as recited in claim 18, wherein the second spline or slot has a length L2 and the second other of the slot or spline has a length L3, and further wherein the length L2 and the length L3 are substantially the same.

20. The downhole tool as recited in claim 19, wherein the length L2 and the length L3 are less than 0.8 meters.

21. The downhole tool as recited in claim 20, wherein the first smaller assembly spline or slot and the first larger bit assembly other of the slot or spline are rotationally offset from the second smaller assembly spline or slot and the second larger bit assembly other of the slot or spline by at least 15 degrees.

22. The downhole tool as recited in claim 12, wherein the smaller assembly spline or slot is a spline and the larger bit assembly other of the slot or spline is a slot.

23. The downhole tool as recited in claim 12, wherein the smaller bit assembly includes one of a lock ring profile or a lock ring, and the larger bit assembly includes an other of the lock ring or the lock ring profile, the lock ring profile and lock ring configured to engage with one another to slidingly fix the smaller bit assembly with the larger bit assembly when the two are slidingly engaged together.

24. The downhole tool as recited in claim 23, wherein the smaller bit assembly includes the lock ring profile and the larger bit assembly includes the lock ring.

25. A well system, comprising:

a main wellbore located within a subterranean formation; and a downhole tool positioned within the main wellbore, the downhole tool including:

a two part drilling and running tool, the two part drilling and running tool including:

a conveyance;

a smaller assembly having a length LS coupled to an end of the conveyance, the smaller assembly having a smaller assembly spline or slot located along an entirety of the length LS thereof; and a larger bit assembly slidably coupled to the conveyance, the larger bit assembly including a larger bit assembly other of the slot or spline, wherein the smaller assembly spline or slot and the larger bit assembly other of the slot or spline engage one another to rotationally fix the smaller assembly relative to the larger bit assembly as the smaller assembly and the larger bit assembly slidingly engage one another to form a combined bit assembly; and a whipstock assembly coupled to the two part drilling and running tool.

26. A method for forming a well system, comprising:

positioning a downhole tool within a wellbore extending through one or more subterranean formations, the downhole tool including:

a two part drilling and running tool, the two part drilling and running tool including:

a conveyance;

a smaller assembly coupled to an end of the conveyance, the smaller assembly having a smaller assembly spline or slot located along an entire length LS thereof, and a larger bit assembly slidably coupled to the conveyance, the larger bit assembly including a larger bit assembly other of the slot or spline, wherein the smaller assembly spline or slot and the larger bit assembly other of the slot or spline engage one another to rotationally fix the smaller assembly relative to the larger bit assembly as the smaller assembly and the larger bit assembly slidingly engage one another to form a combined bit assembly; and a whipstock assembly coupled to the two part drilling and running tool using a coupling mechanism;

rotating the conveyance, the smaller assembly spline or slot and the larger bit assembly other of the slot or spline causing the whipstock assembly to rotate with the conveyance; and retracting the smaller assembly uphole, the smaller assembly engaging with the larger bit assembly to form a combined bit assembly.

* * * * *